United States Patent [19]

Garfield

[11] Patent Number: 5,007,208

[45] Date of Patent: Apr. 16, 1991

[54] ANCHOR FOR ROTARY SANDING DRUM

[76] Inventor: Theodore F. Garfield, Sunset La., Harrison, N.Y. 10528

[21] Appl. No.: 369,981

[22] Filed: Jun. 22, 1989

[51] Int. Cl.[5] ..... B24B 1/00; B24B 7/19; B24B 7/30

[52] U.S. Cl. ..... 51/281 R; 51/367; 51/372

[58] Field of Search ..... 51/DIG. 34, 358, 372, 51/373, 374, 375, 381, 281 R, 391, 392, 394, 401

[56] References Cited

U.S. PATENT DOCUMENTS

| | | | |
|---|---|---|---|
| 667,273 | 2/1901 | Webster | 51/374 |
| 1,852,885 | 4/1932 | Heyer | 51/373 |
| 2,115,897 | 5/1938 | Wooddell et al. | 51/206.4 |
| 2,494,818 | 1/1950 | Kristek | 51/373 |
| 2,499,643 | 3/1950 | Hays | 51/375 |
| 2,745,223 | 5/1956 | Toulmin, Jr. | 51/372 |
| 3,232,011 | 7/1963 | Pineau | 51/373 |
| 3,496,685 | 2/1970 | Schmidt et al. | 51/373 |
| 3,698,141 | 10/1972 | Landmark et al. | 51/372 |
| 3,848,374 | 11/1974 | Hasegawa | 51/373 |
| 4,208,802 | 6/1980 | Berndt | 33/371 |
| 4,707,950 | 11/1987 | Kawasaki | 51/358 |

*Primary Examiner*—Frederick R. Schmidt
*Assistant Examiner*—Marh A. Morris
*Attorney, Agent, or Firm*—Israel Nissenbaum

[57] ABSTRACT

A sanding belt for use on a rotating drum, is anchored on the drum by means of an elongated strip of sandpaper having a length slightly less than the circumference of the outer surface of the drum. The drum is made of a resilient material, such as rubber, and is adapted to be coupled to the chuck of a hand held power drill. The sandpaper strip is positioned between the outer surface of the drum and the inner surface of the sanding belt with the sandpaper grit of the strip being in contact with the sanding belt thereby preventing edgewise creep during utilization.

8 Claims, 1 Drawing Sheet

ANCHOR FOR ROTARY SANDING DRUM

This invention relates to improvements in the mounting of sanding belts on rotating drums, driven by hand held power drills. More particularly, the present invention relates to an improved means for preventing relative movement between the sanding belt and rotating drum during operation.

Rotary drums for sanding belts are generally comprised of a pliant material, such as rubber, upon which a closed loop sanding belt is snugly fitted. However, because of such fitting and the slight amount of slack required for mounting, there is a tendency for the sanding belt to slowly slip or creep off the edge of the rotary drum when the sanding belt is in contact with an object to be sanded. In order to obviate this problem some rotating drums have been constructed with recessed inset areas into which the sanding belt is snugly fitted. This is however a costly modification since the drum and sandpaper must be made with cofitting non-planar surface. In addition, seating of the belt must be exact, otherwise slippage will be exacerbated.

The slippage problem is unique to rotary drum sanders. Orbital sanders utilize sanding strips which are anchored at their ends and slippage is accordingly not a problem. Belt sanders, generally utilized by professionals, provide a non-circular substrate for the sanding belt, which is adjustable to ensure a non-slip engagement. Rotary drum sanders, such as those utilized with hand held power drills, are however made of unitary elements which cannot be made adjustable to take up the slack of the belt.

It is an object of the present invention to provide a simple and economical, yet effective, method to prevent the edgewise creep of a sanding belt on a rotary drum during use.

It is a further object of the present invention to provide a sanding apparatus, for use with a rotating power source, having a reduced incidence of axial displacement of a sanding belt.

These and other objects, features and advantages of the present invention will become more evident from the following discussion as well as the drawings in which.

The present invention provides a method for anchoring a sanding belt on a rotary sanding drum typically utilized with hand held power drills as well as the sanding apparatus being constructed thereby. These drums are formed from a moldable, resilient material, such as natural rubber, so that, when the drum is rotated at a high speed, it will expand or stretch radially outwardly under centrifugal force. This will cause the outer surface of the drum to be pressed firmly against the inner surface of a sanding belt on the drum, to enhance the frictional engagement therebetween. This feature assures that the sanding belt will not move axially of the drum when the drum and belt are rotated. However, the resilient nature of the drum is somewhat problematic when the belt is actually utilized for sanding, particularly against a hard resistant surface. Under such conditions, the drum yields and there is a tendency for the frictional engagement between the sanding belt and the drum to be slightly disrupted with resultant minimal though perceptable edgewise creep of the belt. In order to obviate this problem, in accordance with the present invention, an elongated strip of sandpaper is positioned between the outer surface of the drum and the inner surface of the sanding belt, with the grit of the strip being in contact with the sanding belt. The sandpaper strip, having free ends, expands or contracts in conformity with the adjacent surface of the drum and at the same time exerts a frictional hold against the interior surface of the sanding belt to anchor the sanding belt in position against edgewise creep during utilization. Unless the grade of the sandpaper strip is the same as that of the sanding belt, the width of the strip should be no wider than that of the sanding belt and to ensure a proper anchoring it should not be less than 75% of the width of the rotary drum. Similarly to ensure reliable anchoring it is preferred that the sandpaper strip have a length slightly less than that of the sanding belt but the gap between the ends of the sandpaper strip, when mounted on the drum, should be no more than about 30° of arc on the outer surface of the drum. It is also preferred that the sandpaper strip have at least a medium grit for anchoring engagement with the inner surface of the sandpaper belt.

Figure 1:
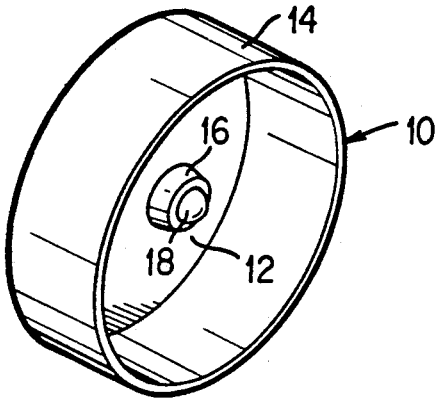
FIG. 1 PRIOR ART
FIG. 1 is a perspective view of a rotary sanding drum prior to placement of a sanding belt thereon.
Figure 2:
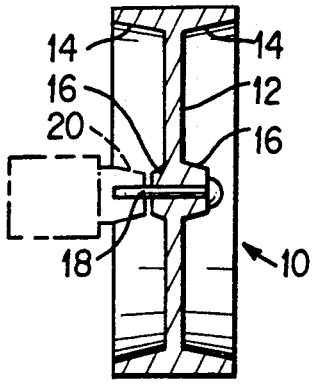
FIG. 2 PRIOR ART
FIG. 2 is a vertical section through the drum and illustrating the way in which it is mounted on the chuck of a hand held power drill.
Figure 3:
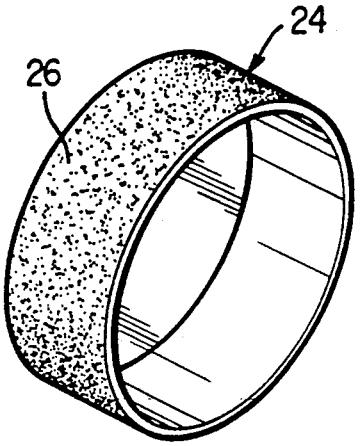
FIG. 3 PRIOR ART
FIG. 3 is a view of the sanding belt used with the drum of FIG. 1.

With reference to the drawings, as shown in FIG. 1, drum 10 is formed from a resilient material and comprises a circular, flexible, imperforate central web 12 and a pair of flexible outer peripheral flanges 14 integral with web 12 so that drum 10 is of a one-piece construction. The web is of a thin wall construction and, as shown in FIGS. 2, is provided with a pair of bosses 16 at the center thereof for support purposes. The bosses project laterally from opposite sides of the web. A pin 18 extends through the boss and the web whereby a chuck 20 on a hand held power drill, or the like, can grip the pin for rotating drum 10 about the central axis of web 12. Flanges 14 have cylindrical outer surfaces and project laterally in opposed directions from the outer periphery of web 12. The flanges have a thin wall construction and, because they are resilient, they are essentially flexible so as to flex radially outwardly when subjected to centrifugal force. Similarly, web 12, being of a thin wall construction, and formed from a resilient material can expand or stretch radially outwardly under centrifugal force as drum 10 is rotated at high speed, such as 2200 rpm or the like. This provides a frictional engagement between the web and the flanges and the inner surface of a sanding belt 24, as shown in FIG. 3, mounted on the drum for rotation. However, while the centrifugal force is normally sufficient to maintain the requisite frictional engagement, the resiliency of the material of flanges 14 will also tend to yield when the drum is placed against a hard resistant surface with resultant edgewise or axial slippage of the belt during use.

Figure 4:
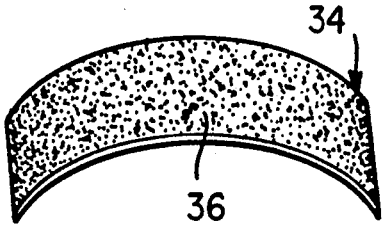
FIG. 4 is a view of the sandpaper strip of the present invention.
Figure 5:
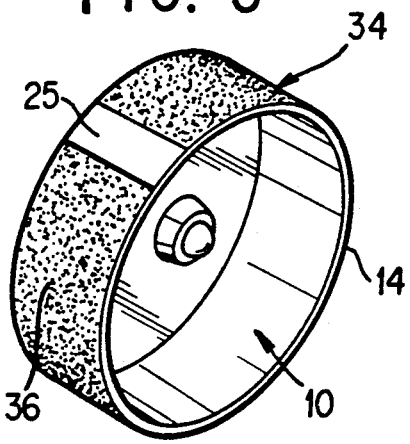
FIG. 5 is a view of the sandpaper strip of FIG. 4 mounted on the sanding drum of FIG. 1.
Figure 6:
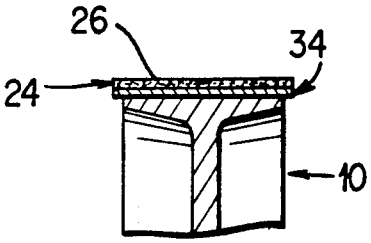
FIG. 6 is a fragmentary sectioned view of the rotary drum of FIG. 2 with the sanding belt of FIG. 3 and the sandpaper strip of FIG. 5 mounted thereon.

To prevent such slippage, in accordance with the present invention, sandpaper strip 34, shown in FIG. 4, is initially positioned on flange 14 of the drum 10, as shown in FIG. 5, with the grit surface 36 facing outwardly away from the drum. The small gap 25 ensures that only a single layer of the sandpaper strip 34 is on the surface of the flange which will not impede mounting of the sanding belt. Such gap should not, however, exceed an area equal to a 30° arc on the circumference of the circular flange. The sanding belt 24 is thereafter mounted on the drum 10 on top of sandpaper strip 34 as shown in FIG. 6. Since flange 14 and web 12 are resilient, they are somewhat compressible for this mounting despite the extra layer of the sandpaper strip and they resiliently return to their original configuration after the belt has been mounted on the drum.

Drum 10 has the following typical dimensions: Maximum diameter of about 3.80 inches (9.6 cm) and about 11.9 inches (30 cm) circumference, web thickness of about 0.25 inch (0.63 cm), total axial length of flanges 14 of about 1.40 inches (3.6 cm). For such drum the sandpaper strip has a length of at least 10.9 inches (27.7 cm) up to 11.9 inches (30 cm) and a minimum width of about 1 inch (2.5 cm). In use, pin 18 is secured in the conventional manner to chuck 20. Sandpaper strip 34 and sanding belt 24 are then sequentially placed on the drum.

The hand held power drill, associated with chuck 20, is then actuated to rotate drum 10 and thereby permit the sanding of a surface by the outer surface 26 of sanding belt 24 which is provided with an abrasive in the usual manner. During the sanding operation, web 12 will expand radially outwardly and flanges 14 will flex outwardly yet web 12 will generally maintain its disc-like shape since it is rotating in its own plane. There will be no circumferential or axial movement of sanding belt 24 relative to flanges 14 during rotation of drum 10 because of the frictional engagement of sandpaper strip 34 and the inner surface of sanding belt 24.

Although the foregoing invention has been described in some detail by way of illustration and example for purposes of clarity of understanding, it will be obvious that certain changes and modification may be practiced within the scope of the appended claims.

What is claimed is:

1. A method for preventing axial slippage, during utilization, of a closed loop sanding belt mounted on a rotating circular drum, comprised of a resilient material; said method comprising the steps of: (a) positioning an elongated strip of sandpaper on the outer surface of said drum, with sandpaper grit of said strip facing outwardly away from said drum; and (b) placing said closed loop sanding belt directly on said strip and in contact with the sandpaper grit thereof; and wherein the length of said strip is less than the outer circumference of said drum.

2. The method of claim 1, wherein, when said strip of sandpaper is positioned on the outer surface of said drum, a gap between the ends of the strip is no greater than about 30° of arc on the outer surface of the drum.

3. The method of claim 2, wherein, when said strip of sandpaper is positioned on the outer surface of said drum, the strip covers an axial length of at least 75% of the outer surface of the drum.

4. The method of claim 1 wherein the sandpaper grit of the strip is at least a medium grit.

5. An apparatus for rotational sanding of objects, said apparatus comprising: (a) a circular drum, comprised of a resilient material, and adapted to be coupled with rotating power source; (b) an elongated strip of sandpaper positioned on the outer surface of said drum, with sandpaper grit of said strip facing outwardly away from said drum; and (c) a closed loop sanding belt mounted directly on said strip and in contact with the sandpaper grit thereof; and wherein the length of said strip is less than the circumference of the outer surface of said drum.

6. The apparatus of claim 5, wherein, when a gap between the ends of the is no greater than about 30° of arc on the outer surface of the drum.

7. The apparatus of claim 6, wherein the strip covers an axial length of least 75% of the outer surface of the drum.

8. The apparatus of claim 5 wherein the sandpaper grit of the strip is at least a medium grit.

* * * * *